US011432063B2

(12) United States Patent
Rugolo

(10) Patent No.: US 11,432,063 B2
(45) Date of Patent: Aug. 30, 2022

(54) MODULAR IN-EAR DEVICE

(71) Applicant: Iyo Inc., Redwood City, CA (US)

(72) Inventor: Jason Rugolo, Mountain View, CA (US)

(73) Assignee: Iyo Inc., Redwood City, CA (US)

( * ) Notice: Subject to any disclaimer, the term of this patent is extended or adjusted under 35 U.S.C. 154(b) by 92 days.

(21) Appl. No.: 16/823,828

(22) Filed: Mar. 19, 2020

(65) Prior Publication Data

US 2020/0221207 A1 Jul. 9, 2020

Related U.S. Application Data

(63) Continuation of application No. 16/176,660, filed on Oct. 31, 2018, now Pat. No. 10,659,862.

(51) Int. Cl.
*H04R 1/10* (2006.01)

(52) U.S. Cl.
CPC ..... *H04R 1/1016* (2013.01); *H04R 1/105* (2013.01); *H04R 1/1025* (2013.01); *H04R 1/1041* (2013.01); *H04R 1/1058* (2013.01); *H04R 2420/07* (2013.01)

(58) Field of Classification Search
CPC .. H04R 1/1016; H04R 1/1025; H04R 1/1041; H04R 1/105; H04R 1/1058
USPC ..... 381/74, 328, 330, 367, 370–371, 376
See application file for complete search history.

(56) References Cited

U.S. PATENT DOCUMENTS

| | | | | |
|---|---|---|---|---|
| 3,475,528 | A * | 10/1969 | Parks | B29C 33/3885 264/222 |
| 5,631,965 | A | 5/1997 | Chang et al. | |
| 6,359,995 | B1 | 3/2002 | Ou | |
| 7,016,512 | B1 | 3/2006 | Feeley | |
| 7,407,035 | B2 | 8/2008 | Stinauer et al. | |
| 7,804,966 | B2 * | 9/2010 | Adams | H04R 1/02 381/87 |
| 8,548,174 | B2 | 10/2013 | Dufresne et al. | |
| 9,516,404 | B2 * | 12/2016 | Parkins | H04M 1/05 |
| 9,774,946 | B2 * | 9/2017 | Parkins | H04R 9/025 |
| 10,779,073 | B2 * | 9/2020 | Kirkpatrick | H04R 1/1016 |
| 11,213,252 | B2 * | 1/2022 | Cross | A61B 5/01 |

(Continued)

FOREIGN PATENT DOCUMENTS

| | | | |
|---|---|---|---|
| CN | 207200920 | U | 4/2018 |
| JP | 2015-173369 | A | 10/2015 |

(Continued)

OTHER PUBLICATIONS

U.S. Appl. No. 16/234,999, Tympanic Membrane Measurement, filed Dec. 28, 2018, 31 pages.

(Continued)

*Primary Examiner* — Disler Paul
(74) *Attorney, Agent, or Firm* — Nicholson De Vos Webster & Elliott LLP

(57) ABSTRACT

An in-ear device includes a molding shaped to hold the in-ear device in an ear, and an audio package configured to emit sound. The audio package is structured to removably attach to the molding. An electronics package is structured to removably couple to the audio package and removably attach to the molding. The electronics package includes a controller to control the sound output from the audio package.

19 Claims, 5 Drawing Sheets

(56) References Cited

U.S. PATENT DOCUMENTS

| | | | | |
|---|---|---|---|---|
| 2007/0149261 | A1* | 6/2007 | Huddart | H04R 5/033 455/575.2 |
| 2008/0205680 | A1 | 8/2008 | Ho et al. | |
| 2008/0279409 | A1 | 11/2008 | Hupkes | |
| 2010/0232612 | A1 | 9/2010 | Basseas et al. | |
| 2011/0096938 | A1 | 4/2011 | Yuan et al. | |
| 2011/0299713 | A1 | 12/2011 | Möller et al. | |
| 2012/0039482 | A1 | 2/2012 | Walsh et al. | |
| 2012/0121094 | A1 | 5/2012 | Solum | |
| 2012/0163640 | A1 | 6/2012 | Sanguino et al. | |
| 2013/0243229 | A1 | 9/2013 | Shennib et al. | |
| 2015/0360030 | A1* | 12/2015 | Cartledge | A61N 1/0472 607/136 |
| 2015/0382123 | A1 | 12/2015 | Jobani | |
| 2016/0066110 | A1 | 3/2016 | Shennib et al. | |
| 2016/0073189 | A1 | 3/2016 | Trajkovski et al. | |
| 2016/0134961 | A1* | 5/2016 | Shaffer | H04R 1/1091 381/74 |
| 2017/0230744 | A1* | 8/2017 | Schrader | G10K 11/17857 |
| 2017/0303027 | A1 | 10/2017 | Barry | |
| 2018/0115816 | A1 | 4/2018 | Panecki et al. | |
| 2019/0130889 | A1 | 5/2019 | Matus et al. | |
| 2019/0268706 | A1 | 8/2019 | Solum et al. | |

FOREIGN PATENT DOCUMENTS

| | | | |
|---|---|---|---|
| JP | 2018-019306 | A | 2/2018 |
| WO | 2020/092088 | A1 | 5/2020 |

OTHER PUBLICATIONS

U.S. Appl. No. 16/235,360, Transparent Sound Device, filed Dec. 28, 2018, 29 pages.

U.S. Appl. No. 16/235,417, Open-Canal In-Ear Device, filed Dec. 28, 2018, 23 pages.

U.S. Appl. No. 16/235,092, Optical Otoscope Device, filed Dec. 28, 2018, 27 pages.

International Search Report and Written Opinion dated Feb. 13, 2020 for corresponding International Patent Application No. PCT/US2019/057644, 13 pages.

Notice of Preliminary Rejection, KR App. No 10-2021-7016024, dated May 31, 2022, 9 pages (4 pages of English Translation and 5 pages of Original Document).

Notice of Reasons for Refusal, JP App. No. 2021-520559, dated Jun. 7, 2022, 8 pages (5 pages of English Translation and 3 pages of Original Document).

Office Action, CA App. No. 3116708, dated May 26, 2022, 3 pages.

Supplementary Partial European Search Report and Search Opinion, EP App. No. 19879439.8, dated May 19, 2022, 19 pages.

* cited by examiner

MODULAR IN-EAR DEVICE

CROSS-REFERENCE TO RELATED APPLICATIONS

This application is a continuation of U.S. application Ser. No. 16/176,660, filed on Oct. 31, 2018, which contents are hereby incorporated by reference.

TECHNICAL FIELD

This disclosure relates generally to in-ear devices.

BACKGROUND INFORMATION

Headphones are a pair of loudspeakers worn on or around a user's ears. Circumaural headphones use a band on the top of the user's head to hold the speakers in place over or in the user's ears. Another type of headphones are known as earbuds or earpieces and consist of individual monolithic units that plug into the user's ear canal.

Both headphones and ear buds are becoming more common with increased use of personal electronic devices. For example, people use head phones to connect to their phones to play music, listen to podcasts, etc. However, these devices can be very expensive to achieve high quality sound. If monolithic devices break or wear out, the user needs to buy a new pair.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Figure 1:
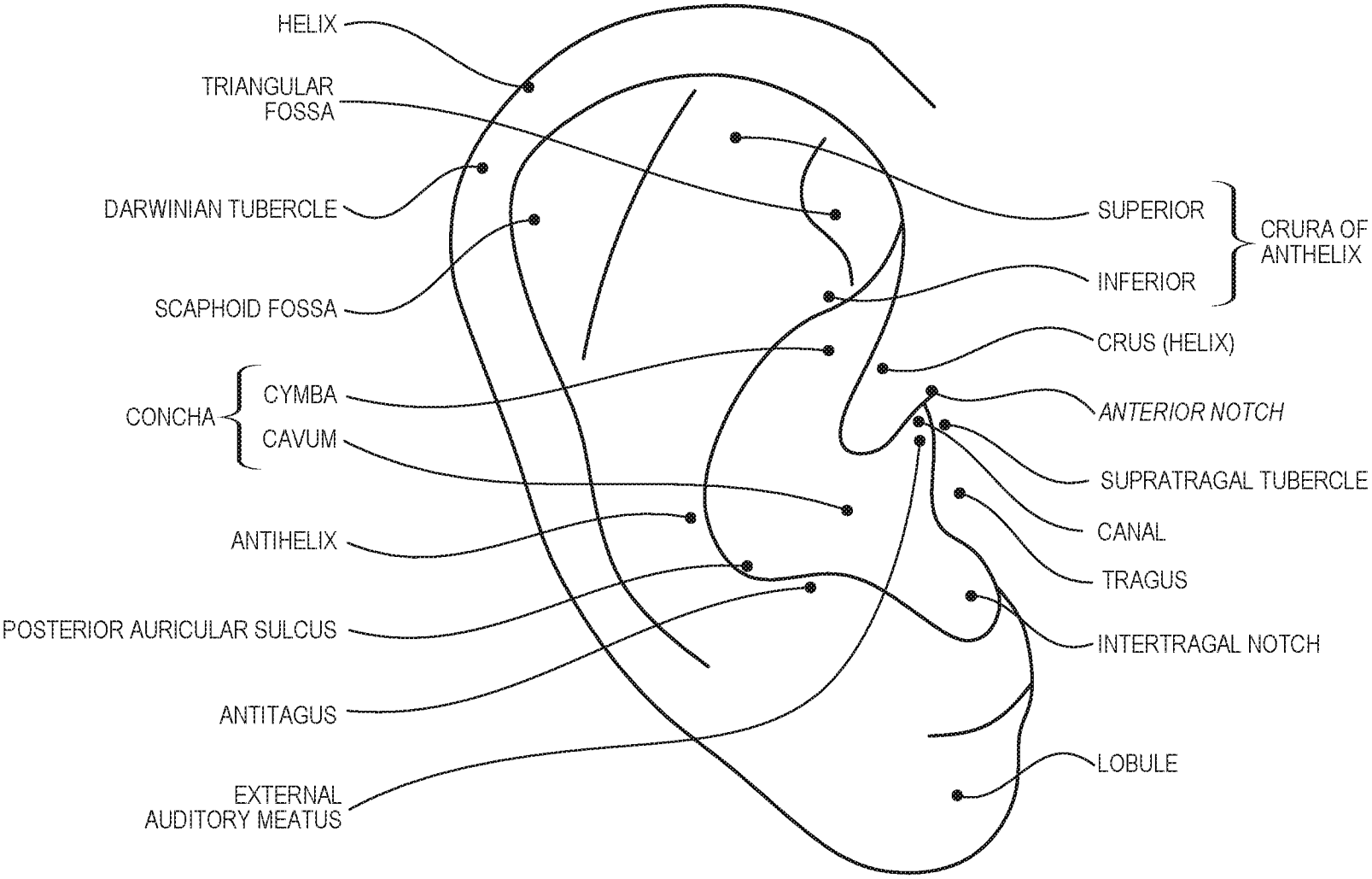
FIG. 1 is a cartoon illustration of human ear anatomy.

Embodiments of a system, apparatus, and method for a modular in-ear device are described herein. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Generally, ear-worn monitors are useful for displaying sounds to the human ear while on the go. Music, directions, digital assistants, and ambient sound modification are all things people desire. Often times, high quality sound augmentation can only be achieved when you can properly eliminate natural sounds. For example, to "delete" the loud train noise from your perceived audio field, you must be able to occlude it or actively cancel it. One way to cancel sound is with mechanical occlusion. However, canal-occluding devices (e.g., ear buds) may be uncomfortable and cannot be worn all the time because of "hot spots" that develop from the imperfect one-size-fits-all interference fit with the ear canal. Further, they may not provide enough occlusion in loud environments where sound occluding devices must be worn for extended periods of time, (e.g., professional music, construction, etc.).

It is possible to create single piece hard (e.g., hard plastic) headphones having the geometry of your outer ear and making a custom fitting device which is both more occluding and more comfortable to wear for a long period. However, these single piece devices may be expensive, difficult to take in and out, and are more likely to get "gunked up" by cerumen and sebum, the ear canal waxes and oils. Here, we present a device, system, and method for a custom fitting, high occluding, and comfortable (all-day wear) device. In some embodiments, the device has three parts.

The first part is a custom ear molding soft polymer interface. The molding is made by obtaining the ear geometry, generating the optimal surface shape digitally, and manufacturing a "sleeve" for the audio package (described later). This molding may be very inexpensive, produced of a soft biocompatible material like silicone, and be replaced upon degradation. After the initial measurements are taken, the user may reorder new moldings at little cost (e.g., the moldings may be 3D printed) once the moldings are worn down or "gunked up".

The second part is the audio package, which may include balanced armature-type components (or other speaker devices) that fit in a pocket within the soft polymer custom ear molding. This part can be mass produced, reducing costs substantially, and increasing reliability. This part may be somewhat expensive, but also will likely be the longest lived part in the device, and its modularity is important for cost savings as one continues to upgrade their in-ear device.

The third part is an electronics package, which "snaps" onto the outside of the audio package. This package can take the shape of a "coin", be magnetically attached to the audio package with electrical contact pins in appropriate places, and contains other electronics, including but not limited to radios, audio processing ASICs, microphones, amplifiers, microprocessors, and a battery. This electronic "coin" can be easily removed and charged. Via mass production, enabled by the modular nature of this concept, the electronics package could conceivably be inexpensive enough to have two pairs on your person. Thus, in this embodiment, thinness can be preserved as battery life only needs to be half of a normal wearing time. Further, as algorithms, batteries, and custom audio processing integrated circuits improve, this part can be updated without new ear scans, custom manufacturing, or pricey audio driver replacement.

Thus, embodiments of this modular device allow the user to use, and regularly replace, a soft comfortable custom ear piece at minimal cost. The device also allows the user to upgrade the hardware/firmware of the device at minimal cost, since the "smarts" of the device may be included in a separate detachable electronics package that can be mass produced. The device lets the user keep and reuse the most expensive (and least likely to break or become technologically obsolete) portion of the in-ear device: the audio package. Additionally, the user may carry around multiple electronics packages functionally extending the battery life of the in-ear device by being able to swap out expended batteries for fully charged batteries. Accordingly, the embodiments disclosed herein provide a much better user experience than one-piece monolithic ear buds that either must be completely replaced if they degrade, break, or become technologically obsolescent.

The following disclosure will describe the embodiments discussed above, and other embodiments, as they relate to the figures.

FIG. 1 is a cartoon illustration of human ear anatomy. The anatomy depicted may be referenced in connection with how the in-ear device (see, e.g., FIG. 2) fits inside the ear. Shown are the location of the helix, triangular fossa, Darwinian tubercle, scaphoid fossa, concha (including the cymba and cavum), antihelix, posterior auricular sulcus, antitagus, external auditory meatus, crura of anthelix (both superior and inferior), crus, anterior notch, supratragal tubercle, canal, tragus, intertragal notch, and lobule.

Figure 2A:
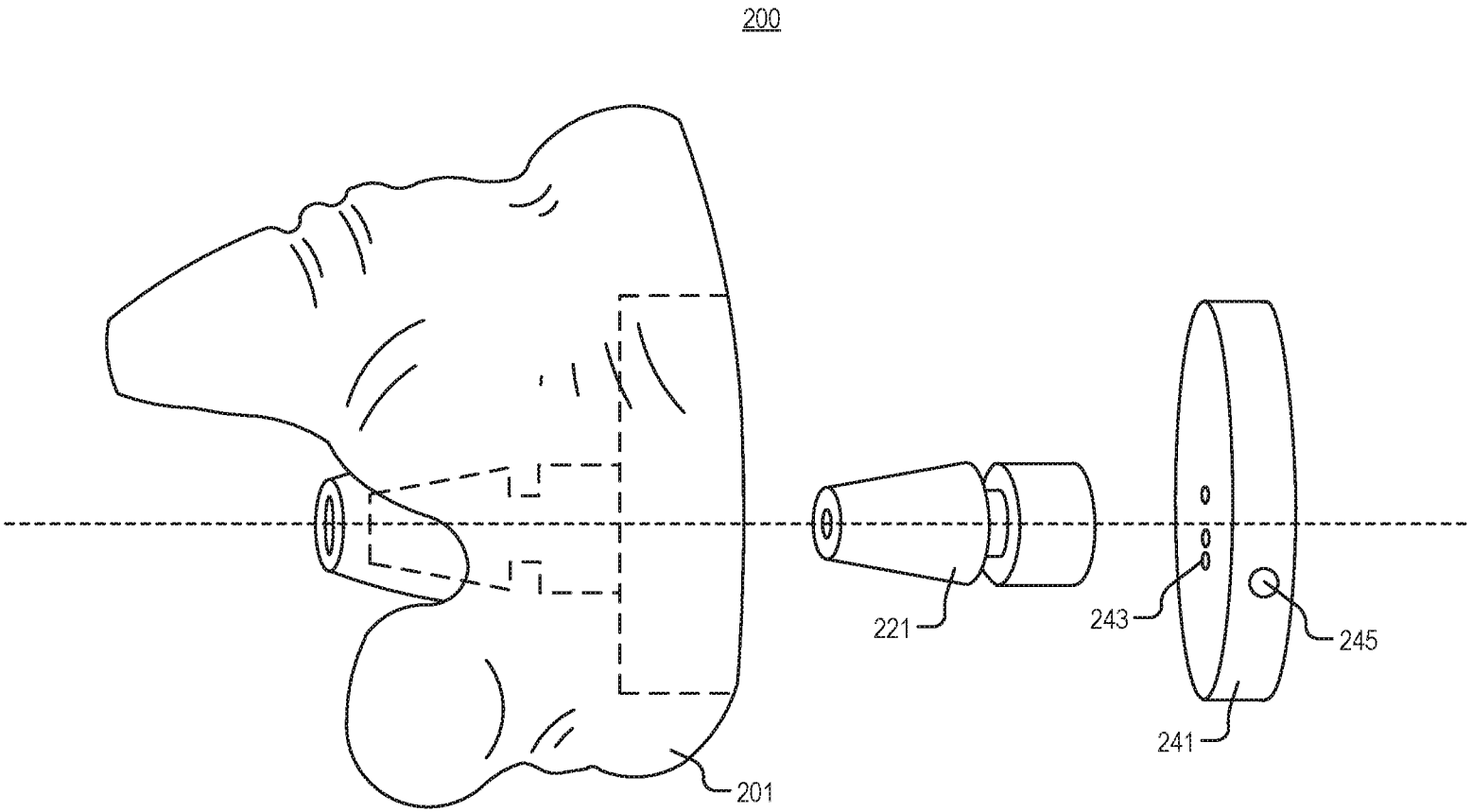
FIG. 2A illustrates a modular in-ear device, in accordance with an embodiment of the disclosure.

FIG. 2A illustrates a modular in-ear device 200, in accordance with an embodiment of the disclosure. The depicted embodiment shows a molding 201, an audio package 221, and electronics package 241. However, one of skill in the art will appreciate that there may be additional modular components, or that the components shown may be divided into sub components, in accordance with the teachings of the present disclosure. There may be one in-ear device 200 for each ear (e.g., two in-ear devices 200 may be sold as a set).

As shown, molding 201 is shaped to hold in-ear device 200 in the pinna (outer ear depicted in FIG. 1) and occlude the canal, since it is custom shaped to the user's ear (e.g., by forming a silicon mold of the user's ear, taking optical measurements of the user's ear, or the like). It is appreciated that a custom shaped device is any device where measurements have been taken to fit the device to the user's ear. Audio package 221 is configured to emit sound and structured to removably attach to molding 201. Here, audio package 221 fits within a hollowed out portion (e.g., an enclosure) of the molding, and is mechanically held in place by the soft polymer ridge fitting into the groove in audio package 221; however, one of skill in the art will appreciate that other mechanical attachment techniques may be used to hold audio package 221 in place (e.g., interference fit, snaps, or fasteners). Moreover, in some embodiments, other attachment mechanisms such as magnets or the like may be used to hold audio package 221 in molding 201.

In some embodiments, audio package 221 is sealed in a housing (e.g., plastic molding or the like) to prevent ingression of water, and substances from the ear, into the audio electronic components. However, there may be a hole from which sound is emitted. Electronics in audio package 221 may be fully sealed so that only the sound emitting portions are exposed to the ear.

Depicted here, electronics package 241 is substantially coin shaped and includes electrodes 243 to couple to electrodes on audio package 221. However, in other embodiments, electronics package 241 may not be substantially coin shaped and take other configurations (e.g., square, oval, hexagonal, abstract shaped, or the like). Additionally, electronics package 241 includes a port 245 (e.g., to receive a headphone-jack shaped electrode) to charge, or communicate with, electronics package 241. However, as will be shown, in many embodiments, electronics package 241 may charge and communicate with other devices wirelessly. Electronics package 241 is structured to removably couple to audio package 221 (e.g., magnetically—using neodymium, iron, or the like; physically—using friction, snap, or Velcro adhesion; chemically—with a releasable polymer or the like) and removably attach to the molding. For example, electronics package may attach to molding 201 by only adhering to audio package 221 (which has already been attached to molding 201, thereby "attaching" electronics package 241 to molding 201). However, in other embodiments, electronics package 241 both attaches to audio package 221, and physically attaches to molding 201 (e.g., fitting within the substantially coin-shaped recess of molding 201). Like audio package 221, in some embodiments, electronics package 241 may be sealed in a discrete housing (separate from the housing of audio package 221) to prevent ingression of water and substances from the ear. This way the electronics in electronics package 241 do not corrode or fail.

Figure 2B:
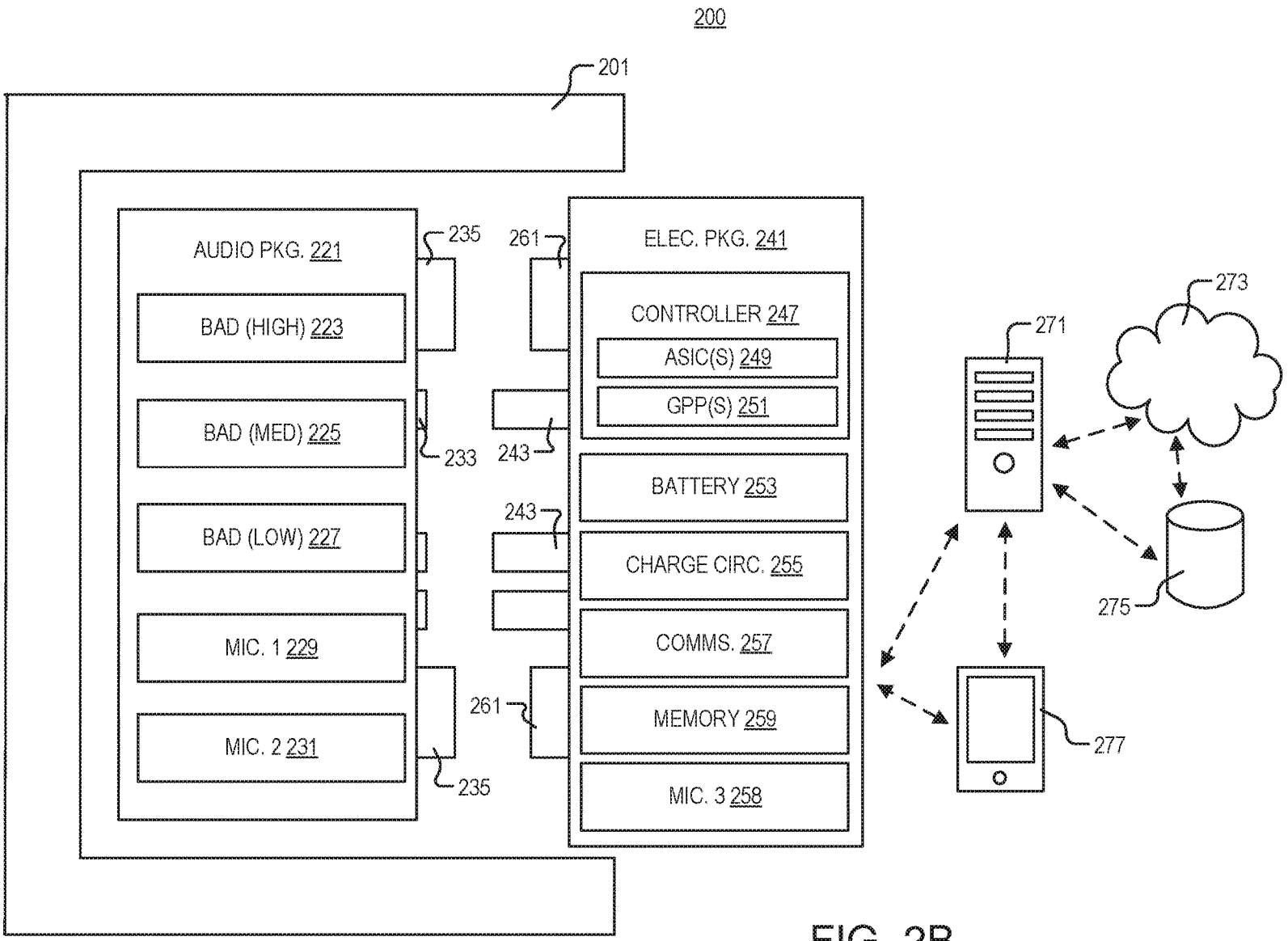
FIG. 2B illustrates a block diagram of the modular in-ear device of FIG. 2A, in accordance with an embodiment of the disclosure.

FIG. 2B illustrates a block diagram of the modular in-ear device 200 of FIG. 2A, in accordance with an embodiment of the disclosure. One of ordinary skill in the art will appreciate that this is merely a cartoon illustration, and that the devices depicted are not drawn to scale (and not shown as their actual shape). Moreover, all of the electronic components in a piece of device architecture (e.g., audio package 221) are electrically coupled. The devices depicted may have additional or fewer components, in accordance with the teachings of the present disclosure.

Like FIG. 2A, depicted are molding 201, audio package 221, and electronics package 241. As shown, audio package 221 includes audio electronics such as one or more (three) balanced armature drivers (BADs)—a device that produces sound by vibrating a "reed" using an electromagnetic field—including a high-range BAD 221, a mid-range BAD 225, and a low range BAD 227 to produce high, medium, and low pitches, respectively. However, in other embodiments other sound emitting devices may be used (e.g., cone/coil based speakers, or the like). Audio package 221 also includes one or more microphones (e.g., MIC. 1 229, MIC. 2 231) which may have different sized diaphragms, materials, orientations (e.g., one facing towards the external world, and one facing toward the user's ear canal). Microphones 229 and 231 may be used to record external sounds, and in response to receiving the external sound data with controller 247, the in-ear device may emit sound from audio package to reduce a magnitude (e.g., through destructive interference of the sound waves) of the external sound received by the ear drum in the user's ear. It is appreciated that the device herein may not only cancel sound, but amplify select sounds, provide on-demand sound transparency (e.g., recognize sounds and let them "pass though" the device as if they were heard naturally), translate language, provide virtual assistant services (e.g., the headphones record a question, send the natural language data to cloud 273 for processing, and receive a natural language answer to the question), or the like. As stated, one or more of microphones 229 and 231 may be canal microphones (e.g., facing into the ear canal to receive sound in the ear canal such as speech or other sounds generated by the user). The canal microphones may be used to receive the user's speech (e.g., when in-ear device 200 is used to make a phone call) and transmit the recorded sound data to an external device. Canal microphones may also be used for noise cancelation and noise transparency functionality to detect noises made by the user (e.g., chewing, breathing, or the like) and cancel these noises in the occluded (by in-ear device 200) ear canal. It is appreciated that user generated noises can seem especially loud in an occluded canal, and accordingly, it may be desirable to use noise cancelation technologies described herein to cancel these sounds in addition to external sounds.

Electronics package 241 includes a controller 247, which may include one or more application-specific integrated circuits (ASICs) 249 to handle specific signal processing tasks, and/or one or more general purpose processors (GPPs) 251. Controller may include logic (e.g., implemented in hardware, software, on the cloud/across a distributed system, or a combination thereof) that when executed by the controller causes the in-ear device to perform a variety of operations. Operations may include playing music/audio, performing noise cancelation computations, or the like. Battery 253 (e.g., a lithium-ion battery or the like) or other energy storage device (e.g., capacitor) is also included in electronics package 241 to provide power to controller 247 and other circuitry. Charging circuitry 255 (e.g., inductive charging loop, direct plug in, or the like) is coupled to battery 253 to charge battery 253. Communications circuitry 257 (e.g., transmitter, receiver, or transceiver) is coupled to communicate with one or more external devices (e.g., wireless router, smart phone, tablet, cellphone network, etc.) via Wi-Fi, Bluetooth, or other communication protocol. In the depicted embodiment, electronics package 241 also includes one or more microphones (e.g., MIC. 3 258). This may serve the same purpose as the microphones in audio package 221: record sounds for uploading to an external device, noise cancellation functionality, or noise transparency functionality. It is appreciated that many of the same electronic devices may be included in both audio package 221 and electronics package 241, and that the electronic devices may be combined in any suitable manner, in accordance with the teachings of the present disclosure.

As stated above, controller 247 may include logic (or be coupled to remote logic) that performs real time, or near real time, noise cancelation, sound transparency, and sound augmentation functions. For example, local or remote logic may include machine learning algorithms (e.g., a neural network trained to recognize specific sound features, recurrent neural network, long short-term memory network, or the like), and other computational techniques (e.g., heuristics and thresholding), which may be used individually and in combination to recognize specific sounds and cancel or amplify these sounds. For example, the user may select never to hear a car horn honk again, unless it's proximity is very close (e.g., as measured by volume or other technique). The machine learning model (and other algorithms) will be trained to filter and suppress car horns unless it detected that the sound was within a threshold proximity of the user. Or if the user wanted to tune out a conversation, the user could prevent themselves from hearing the conversation, except if a certain word or phrase was spoken, then the system here could selectively pass that portion of the conversation through (e.g., smart cancelation of certain sounds). In some examples, the system my perform real time, or near real time, translation (e.g., where the user doesn't hear a third party speaking in Spanish, but instead hears the words in English in their ear). Processing of this sound modification functionality could occur locally, on the cloud, or a combination thereof, depending on the processing requirements and the hardware available.

The system may also include logic to "pass" sounds in a way that they retain their spatial information (e.g., so the user knows which direction the sound is coming from)—information that is often lost when wearing occluding devices. Similarly, the system may cancel sound generated by the user (e.g., chewing, breathing, etc.) which are often perceived louder when the ear canal is closed. As stated above, users may select which sounds/noises they would like to hear, and which ones to remove using a user interface, described below. In one embodiment this may be from a list of common noises, or noises specific to the user.

In the depicted embodiment, electronics package 241 includes one or more magnets 261, which may be used to connect electronics package 241 to audio package 221. Audio package 221 may have magnets 235 with complementary orientation (e.g., N to S) to magnets 261 on electrical package 241, so that when placed together audio package 221 and electronics package 241 automatically align. This way, electrodes 243 on electrical package 241 may automatically align with the proper corresponding electrodes 233 on audio package 221. Put another way, audio package 221 includes first electrodes 233, and electronics package 241 includes second electrodes 243, and the first electrodes 233 and the second electrodes 243 are positioned to self-align when the electronics package 241 magnetically attaches to the audio package 221 (however, as stated above, other attachment methods may be used in accordance with the teachings of the present disclosure). This allows audio package 221 and electrical package 241 to electrically couple and communicate. In some embodiments, the protruding electrodes 243 (which may be on either audio package 221 or electrical package 241), may be spring loaded and retract into their respective package (e.g., here, electrical package 241) when the packages are not in contact.

As shown, communication circuitry 257 may communicate with a smart phone/tablet 277 or other portable electronic device, and/or one or more servers 271 and storage 275 which are part of the "cloud" 273. Data may be transmitted to the external devices from in-ear device 200, for example recordings from microphones 229/231 may be sent to smart phone 277 and uploaded to the cloud. Conversely, data may be downloaded from one or more external devices; for example, music may be retrieved from smart phone 277 or directly from a Wi-Fi network (e.g., in the user's house). The smart phone 277 or other remote devices may be used to interact with, and control, in-ear device 200 manually (e.g., through a user interface like an app) or automatically (e.g., automatic data synch). In some embodiments, the one or more external devices depicted may be used to perform calculations that are processor intensive and send the results back to the in-ear device 200.

Figure 3:
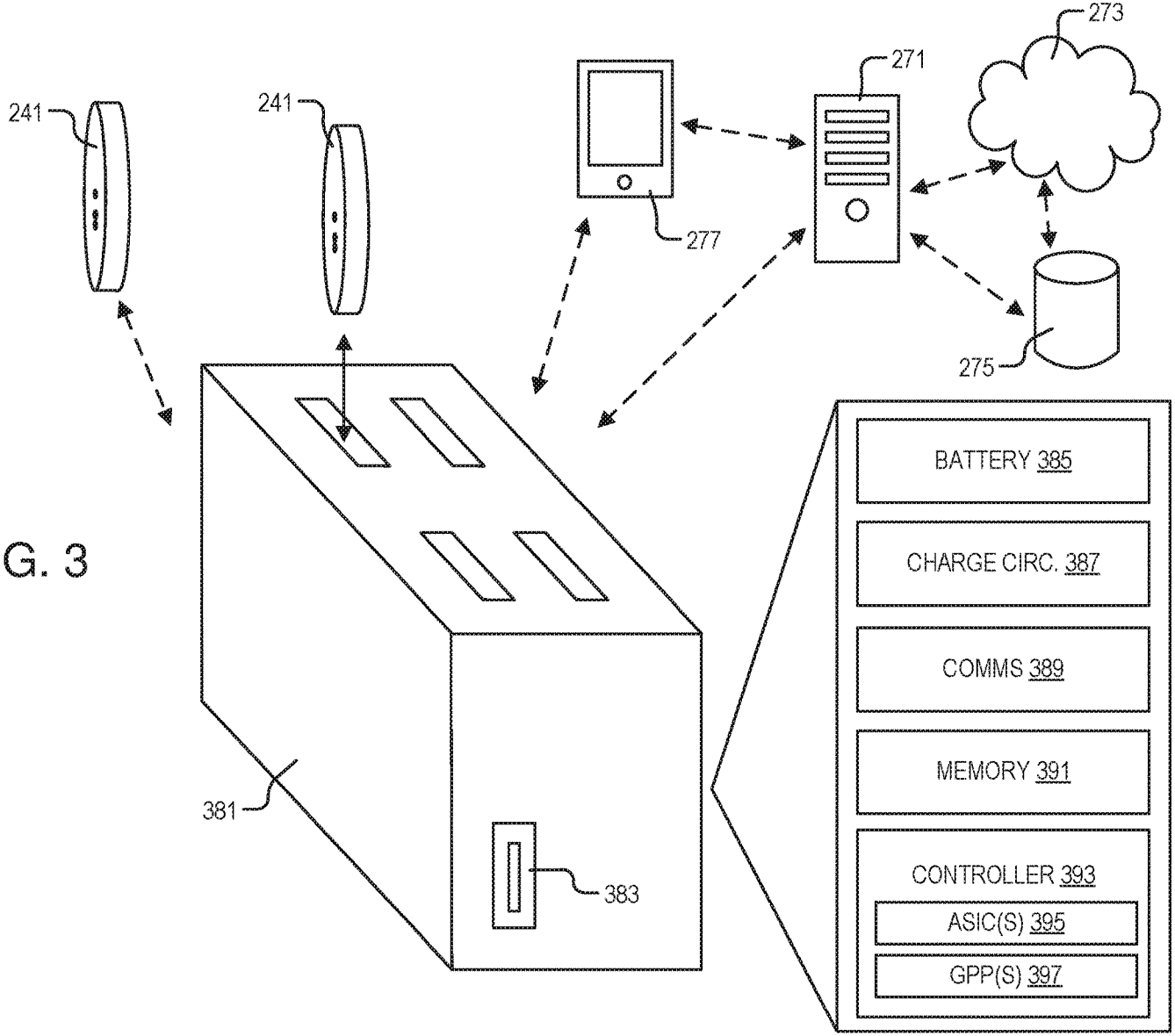
FIG. 3 illustrates part of a system for charging the electronics package included in the in-ear device of FIGS. 2A-2B, in accordance with an embodiment of the disclosure.

FIG. 3 illustrates part of a system 381 for charging the electronics package 241 included in the in-ear device 200 of FIGS. 2A-2B, in accordance with an embodiment of the disclosure. As depicted, charging system 381 includes a small box with slots shaped to receive the coin-shaped (or, as described above, other shaped) electronics packages 241. In the depicted embodiment, electronics packages 241 may be inserted into the slots to charge (e.g., via an inductive charging loop or with direct electrical connection of electrodes). Electronics packages 241 may stick partially out of the slots so they can be easily removed and inserted into the in-ear device.

In the depicted embodiment, charging system 381 has four slots to hold four electronics packages 241; however, in other embodiments, there may be more slots or fewer slots.

As shown, charging system 381 includes battery 385, charging circuitry 387, communication circuitry 389, memory 391, and controller 393. Controller 393 may include one or more ASICs 395 and one or more general-purpose processors 397. As shown, charging system 381 may communicate wirelessly (e.g., dashed line) with electronics packages 241 that are disposed within the ear of the user. For example, electronics packages 2141 may communicate their level of charge to charging system 381, and charging system 381 can calculate the total amount of charge left for the entire system (e.g., the sum of the charge contained within charging system 381 and the remaining charge in electronics packages 241).

In one embodiment, charging system 381 includes a port 383 (e.g., a micro USB port or the like) to charge battery 385. In some embodiments, charging system 381 may be small enough to fit into most pockets (e.g., 2"×2"×0.5"). Since charging system 381 only needs to hold the electronics package 241 "coins", and not the entire assembled in-ear device 200, charging system may be smaller (in one or more dimensions) than the in-ear device.

As shown charging system 381 may communicate with external devices such a smartphone/tablet 277, one or more servers 271, storage 275, which may be all part of cloud 273. Electronics package 381 may communicate with these devices either wirelessly or by wires (e.g., through a wire connecting port 383 to smartphone 277, or through Bluetooth, Wi-Fi, or the like). Communication circuitry 398 may transmit information such as the total level of charge of charging system 381 to the external devices, so the user has real-time information about the level of charge. Charging system 381 can also send other information (e.g., the number of electronics packages 241 contained within charging system 381) to the external devices.

Figure 4:
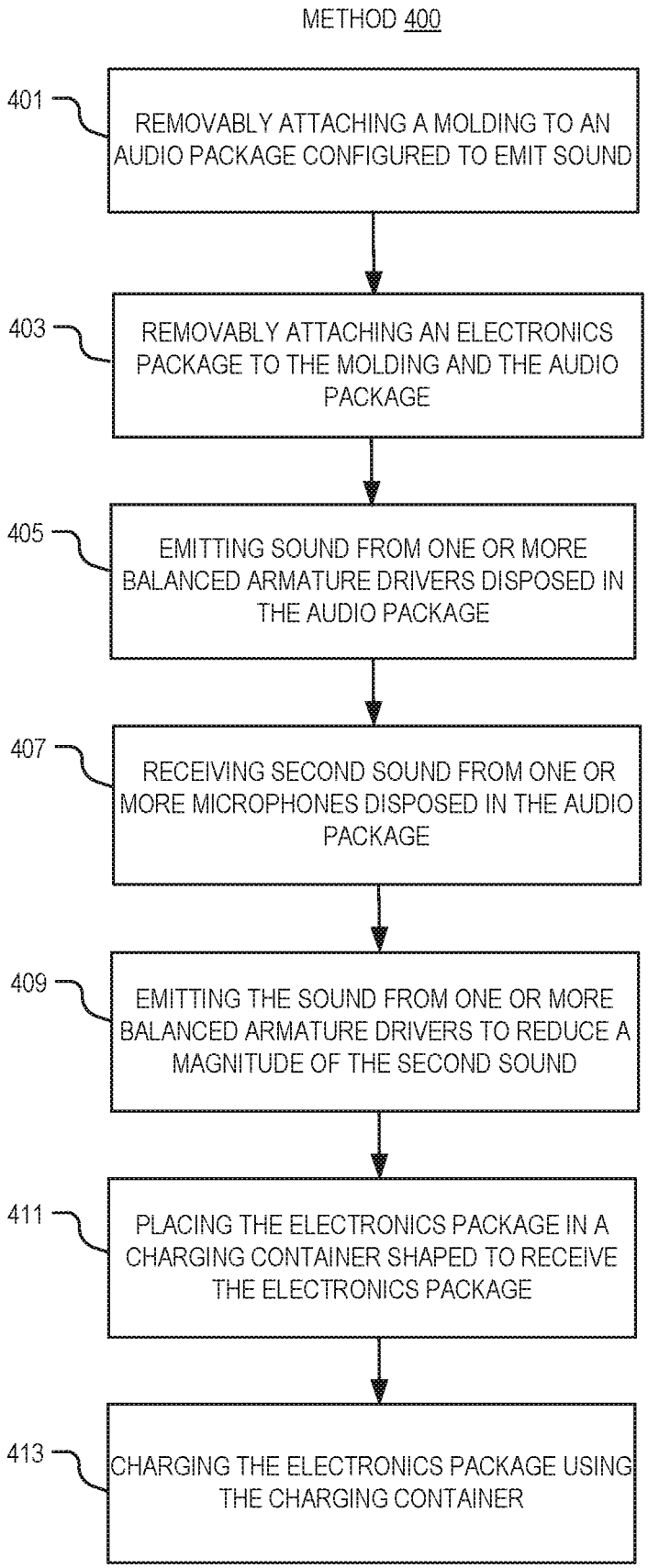
FIG. 4 illustrates a method of using an in-ear device, in accordance with an embodiment of the disclosure.

FIG. 4 is a method 400 of using an in-ear device, in accordance with an embodiment of the disclosure. One of ordinary skill in the art will appreciate that blocks 401-413 may occur in any order and even in parallel. Additionally, blocks may be added to, or removed from, method 400, in accordance with the teachings of the present disclosure.

Block 401 shows removably attaching a molding (which may be custom shaped to fit in an ear, and hold the in-ear device in place) to an audio package configured to emit sound. In some embodiments, this may involve mechanically attaching the molding to the audio package (e.g., interference fit or the like).

Block 403 illustrates removably attaching (e.g., attachable and easily removable without damaging the device) an electronics package to the molding and the audio package. In one embodiment, this may occur after placing the molding in the ear. When the audio package is attached to the electronics package, the electronics package is coupled to communicate with the audio package, and the electronics package includes a controller to control the sound output from the audio package. In one embodiment, the electronics and audio packages may be connected via magnets, latches, interference fit, or the like.

Block 405 depicts, after removably attaching the electronics package to the audio package, emitting sound from one or more balanced armature drivers disposed in the audio package. This may be in response to receiving data (e.g., music, speech, or the like) from an external device with a communication system disposed in the electronics package.

Block 407 shows receiving second sound from one or more microphones disposed in the audio package. This second sound (sound not generated by the audio package) may be internal or external to the ear, and may be perceived as noise to the user. For example, the sound may be the sound of an airplane landing. The one or more microphones that record this sound may transfer the sound data to the controller. The sound may also be recorded from inside the ear (e.g., breathing/chewing).

Block 409 depicts, in response to receiving the second sound data with the controller, emitting the sound from one or more balanced armature drivers to reduce a magnitude of the second sound received by an eardrum in the ear. Put another way, balanced armature drivers (or other sound emitting devices) may emit sound that destructively interferes with the second sound to reduce the magnitude of the pressure wave. Thus, the volume of the external sound (e.g., the airplane landing) is reduced.

As described above, in some embodiments, specific sounds may also be enhanced or "passed" (e.g., recorded with microphones and then output by the speakers) to the user depending on the sound cancellation/enhancement profile selected by the user. Additionally, the system may perform real time, or near real time, language translation. Other sound augmentation may occur such as increasing/decreasing the relative volumes of sounds (e.g., decreasing background noise while increasing sound in a conversation being had with another individual, in person or over the phone). As stated above, the system may also perform calculations to preserve the special orientation of incoming sounds presented to the user (e.g., so the user knows which direction the sound is coming from).

Block 411 illustrates removing the electronics package from the molding and the audio package, and placing the electronics package in a charging container shaped to receive the electronics package. In this embodiment, one or more of the electronics packages that the user had in their ear may have run out of power. Accordingly, the user may take the electronics package out of the in-ear device (e.g., while the rest of the device is still in their ear) and place the electronics package into the charging container.

Block 413 shows charging the electronics package using the charging container (e.g., after the user puts to the electronics package in the charging container). The charging container may include charging circuitry (e.g., inductive loops, exposed electrodes, or the like) to provide power to the electronics package when the electronics package is disposed within the charging container. The electronics package may be held in the charging container magnetically or mechanically (e.g., the charging container may have a lid that closes, or the electronics packages may be held in with an interference fit).

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An in-ear device, comprising:

a molding custom shaped prior to insertion into an ear to match a geometry of the ear and to hold the in-ear device in the ear;

an audio package including audio electronics configured to emit sound, wherein the audio package is structured to removably attach to the molding; and an electronics package structured to removably snap to the audio package and removably attach to the molding, wherein the electronics package includes a controller to control the sound output from the audio package, a battery, and wherein the electronics package is shaped to connect with a charging container.

2. The in-ear device of claim 1, wherein the molding includes a cavity, wherein the audio package includes a first housing in which the audio electronics are disposed, and wherein the first housing is shaped to removably fit into the cavity.

3. The in-ear device of claim 1, wherein the audio electronics include one or more balanced armature drivers or a coil-based speaker to emit the sound.

4. The in-ear device of claim 1, wherein the battery is coupled to supply power to the controller and to the audio package when the electronics package is coupled to the audio package, and wherein the electronics package further includes:

charging circuitry coupled to charge the battery.

5. The in-ear device of claim 1, wherein the electronics package further includes communication circuitry to receive wireless signals from an external device.

6. The in-ear device of claim 1, wherein the audio package mechanically attaches to the molding, and wherein the electronics package magnetically attaches to the audio package.

7. The in-ear device of claim 6, wherein the audio package includes first electrodes, and the electronics package includes second electrodes, and wherein the first electrodes and the second electrodes are positioned to self-align when the electronics package magnetically attaches to the audio package.

8. The in-ear device of claim 1, wherein the electronics package includes one or more microphones positioned to record a second sound and output second sound data to the controller.

9. The in-ear device of claim 8, wherein the controller includes logic that when executed by the controller causes the in-ear device to perform operations including:

in response to receiving the second sound data with the controller, emitting the sound from the audio package to reduce a magnitude of the second sound received by an eardrum in the ear.

10. The in-ear device of claim 2, wherein the electronics package includes a second housing in which the controller is disposed and sealed separate from the audio electronics, wherein the first housing, the second housing, and the molding are distinct and separable from each other.

11. The in-ear device of claim 10, wherein the cavity is a hollowed out portion of the molding and shaped to receive and removably hold the first housing of the audio package and the second housing of the electronics package.

12. A method of using an in-ear device, including:

removably attaching a molding, custom shaped prior to insertion into an ear to match a geometry of the ear and to hold the in-ear device in the ear, to an audio package including audio electronics configured to emit sound;

removably snapping an electronics package to the audio package, wherein when the electronics package is snapped to the audio package the electronics package is coupled to communicate with the audio package, and wherein the electronics package includes a controller to control the sound output from the audio package;

removing the electronics package from the audio package; and placing the electronics package in a charging container shaped to receive the electronics package.

13. The method of claim 12, further comprising:

charging the electronics package using the charging container, wherein the charging container includes charging circuitry to provide power to the electronics package when the electronics package is disposed within the charging container.

14. The method of claim 12, further comprising, after removably attaching the electronics package to the audio package, emitting sound from one or more balanced armature drivers or coil-based speakers disposed in the audio package.

15. The method of claim 14, further comprising:

receiving second sound from one or more microphones disposed in the electronics package; and in response to receiving the second sound, emitting the sound from the one or more balanced armature drivers or coil-based speakers to reduce a magnitude of the second sound received by an eardrum in the ear.

16. The method of claim 12, further comprising receiving data with communication circuitry disposed in the electronics package; and emitting the sound from the audio package in response to receiving the data, after attaching the electronics package to the audio package.

17. The method of claim 12, wherein snapping the electronics package to the audio package comprises coupling the electronics package to the audio package by (i) a magnet, (ii) a friction member, (iii) a chemical adhesive, or (iv) at least two elements selected from a group comprising (i), (ii), and (iii).

18. An in-ear device, comprising:

a molding shaped to hold the in-ear device in an ear, wherein the molding comprises a polymer material that is pre-shaped prior to insertion into the ear to match a geometry of the ear;

an audio package including audio electronics configured to emit sound, wherein the audio package is disposed within a first housing that removably inserts into a cavity of the molding; and an electronics package including:

a controller to control the sound output from the audio package, wherein the electronics package is disposed within a second housing, separate and distinct from the first housing, that removably snaps to the audio package, wherein the first and second housings include electrodes that align to each other when the first and second housings are inserted into the cavity to electrically connect the electronics package to the audio package; and a battery, wherein the electronics package is shaped to connect with a charging container.

19. The in-ear device of claim 18, wherein the second housing snaps to the audio package by (i) a magnet, (ii) a friction member, (iii) a chemical adhesive, or (iv) at least two elements selected from a group comprising (i), (ii), and (iii).

* * * * *